US006238000B1

(12) United States Patent
Hallmark et al.

(10) Patent No.: US 6,238,000 B1
(45) Date of Patent: May 29, 2001

(54) MECHANISM FOR CHAIR

(75) Inventors: Michael C. Hallmark, Lancashire; Simon Roberts, Stockport, both of (GB)

(73) Assignee: Unit Press Limited, Preston (GB)

( * ) Notice: Subject to any disclaimer, the term of this patent is extended or adjusted under 35 U.S.C. 154(b) by 0 days.

(21) Appl. No.: 09/243,438

(22) Filed: Feb. 3, 1999

(30) Foreign Application Priority Data

Feb. 4, 1998 (GB) ..... 9802447

(51) Int. Cl.[7] ..... A47C 1/024

(52) U.S. Cl. ..... 297/300.5; 297/300.8; 297/303.4

(58) Field of Search ..... 297/300.5, 300.8, 297/303.1, 303.4, 303.5

(56) References Cited

U.S. PATENT DOCUMENTS

| | | | | |
|---|---|---|---|---|
| 4,012,158 | | 3/1977 | Harper . | |
| 4,451,084 | | 5/1984 | Seeley . | |
| 4,639,039 | | 1/1987 | Donovan . | |
| 4,660,885 | | 4/1987 | Suhr et al. . | |
| 4,749,230 | | 6/1988 | Tornero . | |
| 4,930,840 | | 6/1990 | Tornero . | |
| 5,026,117 | * | 6/1991 | Faiks et al. | 297/300.5 X |
| 5,037,158 | | 8/1991 | Crawford . | |
| 5,348,372 | | 9/1994 | Takamatsu et al. . | |
| 5,375,912 | | 12/1994 | Stulik et al. . | |
| 5,547,253 | | 8/1996 | Schwartz et al. . | |
| 5,582,460 | | 12/1996 | Schultz . | |
| 5,584,533 | * | 12/1996 | Schrewe | 297/300.5 X |
| 5,586,809 | | 12/1996 | Szmadzinski . | |
| 5,597,204 | | 1/1997 | Karaus, Jr. . | |
| 5,649,741 | | 7/1997 | Beggs . | |
| 5,678,893 | | 10/1997 | Bock . | |
| 5,685,609 | | 11/1997 | Miotto . | |
| 5,695,249 | | 12/1997 | Lotfi . | |
| 5,853,222 | | 12/1998 | Roslind, Jr., et al. . | |
| 5,918,935 | * | 7/1999 | Stulik et al. | 297/300.5 X |
| 5,951,107 | | 9/1999 | Tornero . | |

FOREIGN PATENT DOCUMENTS

| | | |
|---|---|---|
| 0587536 | 3/1994 | (EP) . |
| 27 32870 | 10/1996 | (FR) . |
| 1371641 | 10/1974 | (GB) . |
| 2180147 | 3/1987 | (GB) . |

* cited by examiner

*Primary Examiner*—Anthony D. Barfield
(74) *Attorney, Agent, or Firm*—Hollander Law Firm, P.L.C.

(57) ABSTRACT

An office chair has a seat (1) mounted on a base (2) so that its inclination can be adjusted with a mechanism (4). The mechanism has a spring (28) mounted in compression between the seat and base, and a manual control (20) acts to adjust the extent of compression of the spring and also the direction of application of the spring force so that a generally linear resistance characteristic can be obtained. The spring (28) preferably has a lower support (12) which engages a positionally adjustable fulcrum (15, 18), and an upper support (11) pivotally connected to the lower support (12). The upper support (11) may be rigidly connected via a rigid bar to a chair back (3). A spring and ratchet arrangement (33, 34) may be provided for locking the seat in position relative to the base.

20 Claims, 5 Drawing Sheets

MECHANISM FOR CHAIR

This invention relates to a mechanism for a chair of the kind having a base part, and a seat part mounted on the base part so as to be of adjustable inclination against a spring force relative to the horizontal.

In the case of an office chair of the kind which is used for working at a desk in front of word processing or computer equipment, it is usual for provision to be made for adjustment of seat and back parts of the chair so that the user can attain a desired comfortable sitting position. In particular, the inclination to the horizontal of the seat may be adjustable against a spring force, by means of a mechanism, between forwardly and rearwardly inclined limits. Also, the back may be movable forwardly and rearwardly relative to the seat and it is known to use a so called synchro mechanism which synchronises adjustment of the vertical rake of the back with tilting of the seat, whereby the back moves through a greater angle than the seat, say in accordance with a ratio of 3:2.

Adjustment of the seat angle and the rake of the back is effected with the user seated on the chair. The user leans backwards to cause his of her weight to move the back and the seat against the resistance of the spring force. It is desirable that the spring resistance should be adequate to achieve slow controlled movement but without requiring excessive effort. It is therefore usual to provide an adjustment control to adjust the spring force to suit the weight of the user.

The problem arises, however, that an adjustment control which involves, for example, rotating a screw to tighten or loosen a spring by increasing or releasing compression forces directly along the spring axis may necessitate awkward or unduly strenuous user activity. Also, the problem can arise that increase in spring compression may give rise to accentuation of progressive increase in spring force to the extent that the spring force is not linear throughout the adjustment movement and increases significantly, in an uncomfortable and inconvenient manner, as the chair seat and back approaches the rearmost limits of their travel.

It is to be understood that these problems can be significant especially because it is important to avoid the user being exposed to strain or injury.

Accordingly, one object of the invention is to provide a mechanism for a chair which is simple and convenient to operate and comfortable in use.

According to one aspect of the invention therefore there is provided an adjustable mechanism for a chair, which chair has a base part, and a seat mounted on the base part so as to be of adjustable inclination relative to the horizontal, said mechanism including a spring arrangement disposed in compression to provide a spring force applied in a direction between the base part and the seat part so as to resist said adjustment movement of the seat part, and an adjustment control operable to adjust the disposition of the spring arrangement with reference to extent of compression thereof and also the said direction thereof.

With this arrangement, because the adjustment control moves the direction of spring force application as well as changing compression, a desired resistance characteristic over the path of adjustment movement of the seat part can be more readily attained. In particular, it is possible to maintain a substantially linear resistance characteristic to the user, involving no perceived change in resistance or at least only a slight linear increase in resistance, rather than a significant progressive increase.

Most preferably, adjustment of the disposition of the direction of spring force application involves a change in inclination thereof, and this may be attained by lateral movement of one end of the spring arrangement relative to an opposite end thereof.

Preferably the spring arrangement is mounted, or held captive, at said opposite ends thereof between pivotally interconnected upper and lower supports, said lateral movement being effected by adjustment of the relative angular disposition of the lower support relative to the upper support. Preferably also, the lower support has a free end region which is engageable with a fulcrum member about which the lower support pivots during movement of the upper and lower supports towards and away from each other, and the said adjustment of the relative angular disposition of the upper and lower supports is effected by adjustment of the position of the fulcrum member.

In a particularly preferred embodiment the fulcrum member comprises in combination at least one fixed fulcrum element and at least one positionally adjustable fulcrum element arranged such that the said free end region of the lower spring support engages the (or each) fixed element at an initial phase of movement and subsequently engages the (or each) positionally adjustable fulcrum element. With this arrangement, positional adjustment of the (or each) latter fulcrum element can be effected in an unloaded condition thereby permitting easy and convenient adjustment.

The fulcrum member and the coacting end region of the lower spring support may take any suitable form but are preferably shaped to accommodate easy, controlled relative movement. Thus, one or more shaped, e.g. curved projections or rollers or the like may be used for the fulcrum member, and the end region of the lower spring support may comprise one or more curved and/or angled faces.

The above mentioned arrangement whereby the lower spring support initially contacts one or more fixed fulcrum elements and then contacts one or more positionally adjustable fulcrum elements is preferably achieved by arranging the respective elements in mutually displaced positions and incorporating a linkage which effects movement of the fulcrum member relative to the coacting end region of the lower spring support. This linkage may incorporate a cam follower engageable with a cam slot. For example the cam follower may comprise an axle on the said base part, and the cam slot may be provided on the seat part, although other arrangements are also possible.

The said spring arrangement may comprise a helical coil spring or any other suitable spring arrangement including leaf springs, rubber springs, gas cylinders.

The chair may also include a back part and this may be connected to the mechanism so that it moves with tilting of the seat part in accordance with any suitable desired relationship. A synchro arrangement may be used whereby the back is capable of rearward movement through a greater angle than the seat in accordance with a predetermined ratio (say 3:2), although other arrangements are also possible.

The back part may be rigidly mounted on the above mentioned upper spring support. This may be achieved via a rigid L-shaped plate member and one limb of this may be firmly anchored within a slot or other means in the upper support.

Alternatively or additionally the upper spring support may comprise a body part with an attached rearwardly projecting rigid elongate support member which provides support for the back. With this arrangement the back can be adequately supported without requiring a massive structure for the said body part.

Thus and in accordance with a second aspect of the present invention there is provided a mechanism for a chair which has a base part, and a seat mounted on the base part so as to be of adjustable inclination relative to the horizontal, said mechanism including a spring arrangement disposed in compression between upper and lower spring supports respectively connected between the base part and the seat part, and a back part supported on the upper spring support, wherein the upper spring support comprises a body part with an attached rearwardly projecting rigid elongate support member which provides support for the back part.

The elongate support member may comprise a U-shaped steel bar.

A locking mechanism is preferably provided for holding the seat part relative to the base part in a selected angular relationship and this may comprise at least one tooth member engageable between teeth of a rack or ratchet member. A spring may be provided and this may be of reversible effect, preferably under the action of a manual control, whereby in one mode it acts to urge the (or each) tooth member into locking engagement with the rack or ratchet, and in a further mode it acts to urge the (or each) tooth member out of engagement with the rack or ratchet such that disengagement, i.e. unlocking, is possible after removal of transverse force. In this way it can be assured that the locking mechanism only releases when a person sitting on the chair removes or reduces force on the locking mechanism as for example by shifting his or her weight backwards against the back part. In this way unexpected or sudden rear movement can be prevented on release operation of the locking mechanism.

Thus and in accordance with a third aspect of the present invention there is provided a locking mechanism, suitable for use with a mechanism of the kind described above, comprising at least one tooth member engageable between teeth of at least one rack or ratchet member, a spring arrangement operable in two modes respectively to urge the (or each) tooth member into engagement with the (or each) rack or ratchet and to urge the (or each) tooth member out of such engagement on release of retaining force acting on the (or each) said tooth member transversely thereto along the (or each) rack or ratchet, and a control for switching between said modes.

The invention will now be described further by way of example only and with reference to the accompanying drawings in which.

Figure 1:
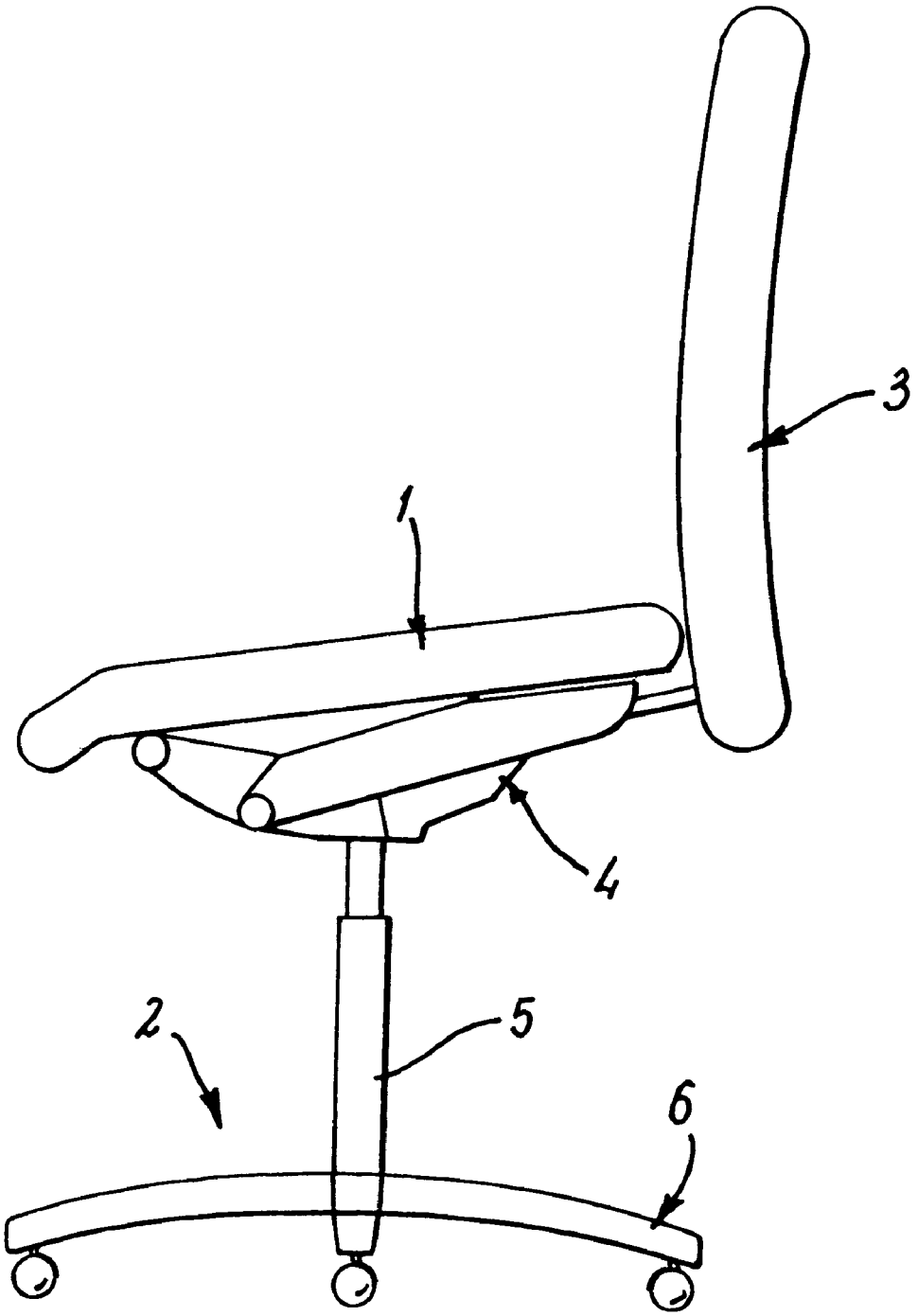
FIG. 1 is a diagrammatic view of a chair incorporating one form of a mechanism according to the invention.
Figure 2:
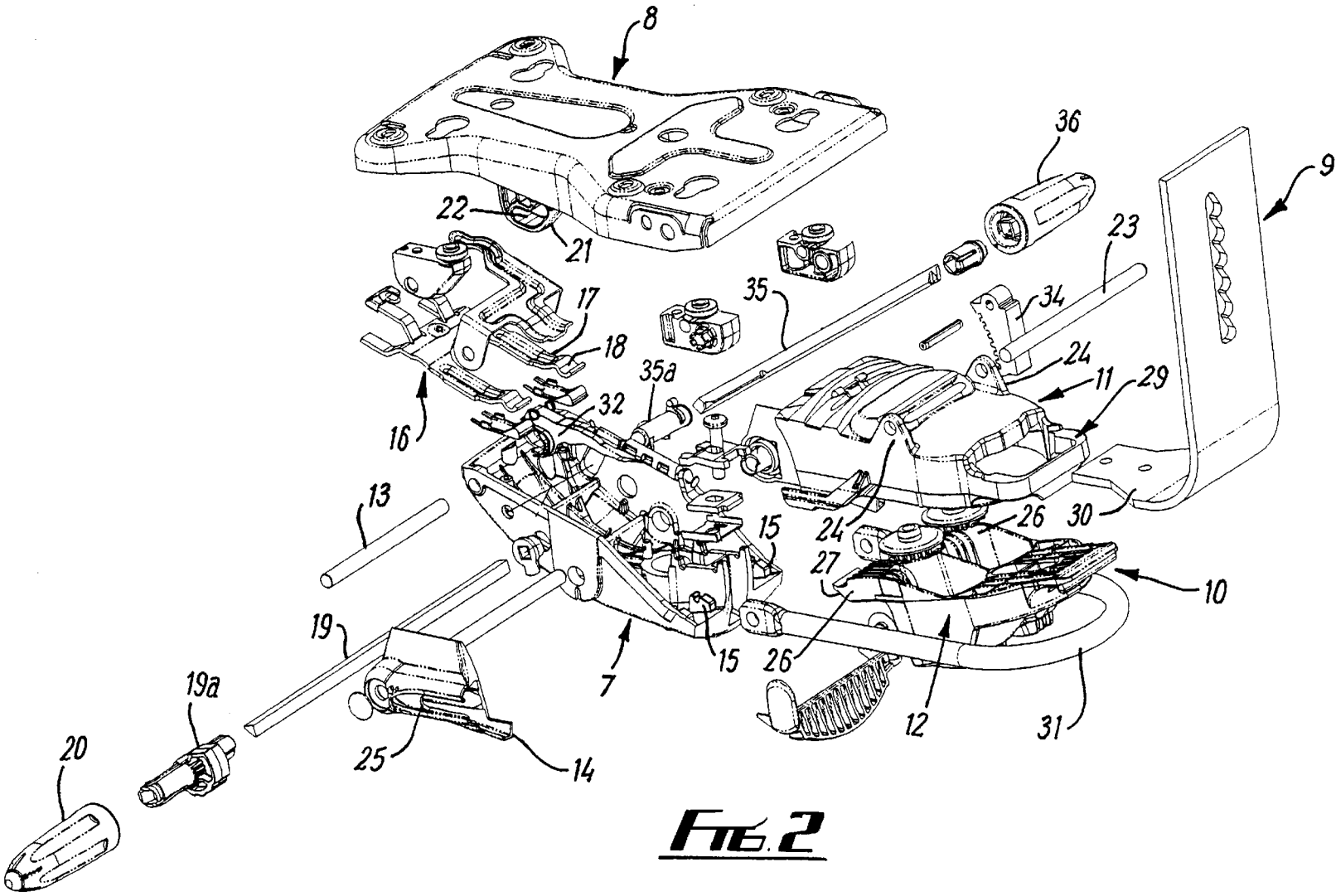
FIG. 2 is an exploded perspective view of the mechanism.

Referring to the drawings, FIG. 1 shows an office chair having a seat part 1, a base part 2, and a back part 3, all interconnected via a mechanism 4.

The base part comprises a vertical central support pillar 5 attached at its lower end to a five-arm wheeled floor-engaging structure 6. At its upper end the pillar 5 is attached to a bottom part 7 of the mechanism 4 beneath the seat part 1. In conventional manner the pillar 5 contains a gas cylinder height adjusting mechanism which is operated by a manual control (not shown) comprising a cam on a shaft which engages with a valve at the end of the gas cylinder on operation of the shaft by means of a control knob or lever.

The seat part 1 comprises a padded seat structure on a frame which is attached to a top part 8 of the mechanism 4.

The back part 3 comprises a padded back structure which is adjustably attached to an upstanding arm of a rigid L-shaped plate member 9 which is attached to an intermediate part 10 of the mechanism.

Referring now to the mechanism, this is formed from a number of pivotally interconnected rigid structures, namely the above mentioned bottom and top parts 7, 8, and upper and lower sections 11,12 of the mentioned intermediate part 10.

The bottom part 7 comprises an upwardly open shell which is mounted rigidly at a central position offset towards a forward end thereof on the top of the pillar 5. A front axle 13 is mounted horizontally across the forward end of the bottom part 7 and projects freely at opposite ends.

A main pivot axle 14 is mounted horizontally across the central region of the bottom part 7.

The rearward end of the bottom part 7 is open and has two upwardly directed fixed projections 15 with curved top surfaces. Within the bottom part there is movably mounted a forked structure 16 having two rearwardly directed arms 17 with upwardly directed projections 18 with upwardly curved top sections generally of like shape to the fixed projections 15. The forked structure 16 can be moved forwardly and rearwardly with the projections 18 on the structure 16 running respectively alongside the fixed projections 15. This movement is effected by rotation of a horizontal square section shaft 19 extending through the bottom part and terminating at one end in a manual control lever 20. The arrangement is such that rotation of the shaft 19 with the lever 20 causes the forked structure 16 to move stepwise and to retain its position in one such step when rotation of the shaft 19 is arrested.

The top part 8 comprises a downwardly open tray or shell which has on opposite sides two downwardly projecting fixtures 21 with mutually aligned generally L-shaped cam slots 22 which run downwardly and forwardly through a curved path. These fixtures 21 are engaged by the opposite projecting ends of the forward axle 13 on the bottom part 7.

At the rearward end of the top part 8 there is a transverse pivot shaft 23 mounted horizontally across the top part 8 (in downwardly projecting features).

The intermediate part 10 has an upper downwardly open shell section 11 with upwardly directed features 24 at opposite sides with mutually aligned holes therethrough. By means of these features 24, this upper shell section 11 is pivotally mounted on the pivot shaft 23 at the rearward end of the top part 8.

Side walls of the upper section 11 fit outwardly of side walls of the bottom part 7 and longitudinally slidably engage links 25 which are pivotally mounted on opposite projecting ends of the main pivot axle 14.

The lower intermediate section 12 is an upwardly open shell which is pivotally mounted at its rearward end to the rearward end of the upper section 11.

At its forward end the lower section 12 has two forwardly projecting arms 26 with downwardly facing ramp surfaces 27 which engage the projections 15, 18 of the bottom part 7 in a manner yet to be described.

Between the upper and lower sections 11, 12 there is a powerful spring 28 which acts to pivot the sections 11, 12 apart. This may comprise a helical coil spring, or any other suitable spring arrangement.

The upper section 11 has a rearwardly opening slot 29 into which extends the bottom forwardly directed limb 30 of the L-shaped back support 9, such limb 30 being held securely in position by means of fixing bolts engaging holes in the limb 30 and the upper section 11.

A rigid U-shaped metal rod structure 31 projects rearwardly from the upper section 11 and is mounted at its free ends on the section 11 to provide rigid support for the chair back.

Between the top part 8 and the bottom part 7 there is a ratchet locking mechanism which retains the seat part in a desired angular disposition relative to the horizontal by locking the upper section 11 of the intermediate part 10 in a selected angular position relative to the bottom part 7. This locking mechanism comprises a fork 32 on the bottom part 7 which projects rearwardly and supports a tooth member 33 which is engageable with a toothed ratchet 34 mounted at the rear end of the upper intermediate section 11. The fork 32 is mounted on a horizontal square section shaft 35 via a cam bush 35*a*, which shaft projects at one side and terminates in a manual control lever 36. The shaft 35 can be rotated between release and locking positions at which the tooth member 33 is respectively free to separate from, and is held in fixed engagement with, the ratchet teeth 34 in a manner described in more detail hereinafter.

In use, the arrangement so far described operates as follows:

With the tooth member 33 released from the ratchet 34, the top part 8 is free to tilt relative to the horizontal between respective limit positions at which it is inclined at an angle downwards to the front, and at an angle downwards to the rear.

Movement of the top part 8 occurs under the action of the weight of a person seated on the chair, by shifting his or her weight forwards or rearwards. At the same time, the chair back 3 pivots forwardly and rearwardly in synchronism with tilting of the seat in accordance with a predetermined ratio of relative angular movement (typically 3:2 although any other suitable ratio including 1:1 can be used), this being achieved by pivotting of the upper section 11 with the U-Bar 31 on the pivot bearing 25 on the main pivot axle 14.

Tilting of the seat rearwardly occurs against the resistance of the springs 28 held captive between the upper and lower sections 11,12 of the intermediate part 10. That is, as the seat tilts rearwardly the springs 28 are compressed to a greater extent.

In more detail, the top part 8 and the upper and lower sections 11,12 of the intermediate part 10 are pivotally interconnected with each other and with the fixed bottom part 7 by means of a number of pivotal joints, namely:

i) a forward pivot joint A between the top part 8 and the bottom part 7 via the interengagement of the ends of the axle 13 with the cam slots 22 in the features 21;

ii) a main central pivot joint B between the upper section 11 of the intermediate part 10 via the connection between the upper section 11 and the main pivot axle 14 in conjunction with the U-Bar 31;

iii) a sliding pivot joint C between the ramp surfaces 27 of the projecting arms 26 of the lower section 12 of the intermediate part 10 and the projections 15, 18 on the bottom part;

iv) a trailing pivot joint D between the rearward ends of the upper and lower sections 11,12 of the intermediate part 10; and v) a rearward pivot joint E between the upwardly projecting features 24 on the upper section 11 of the intermediate part 10 and the top part 8.

Figure 3:
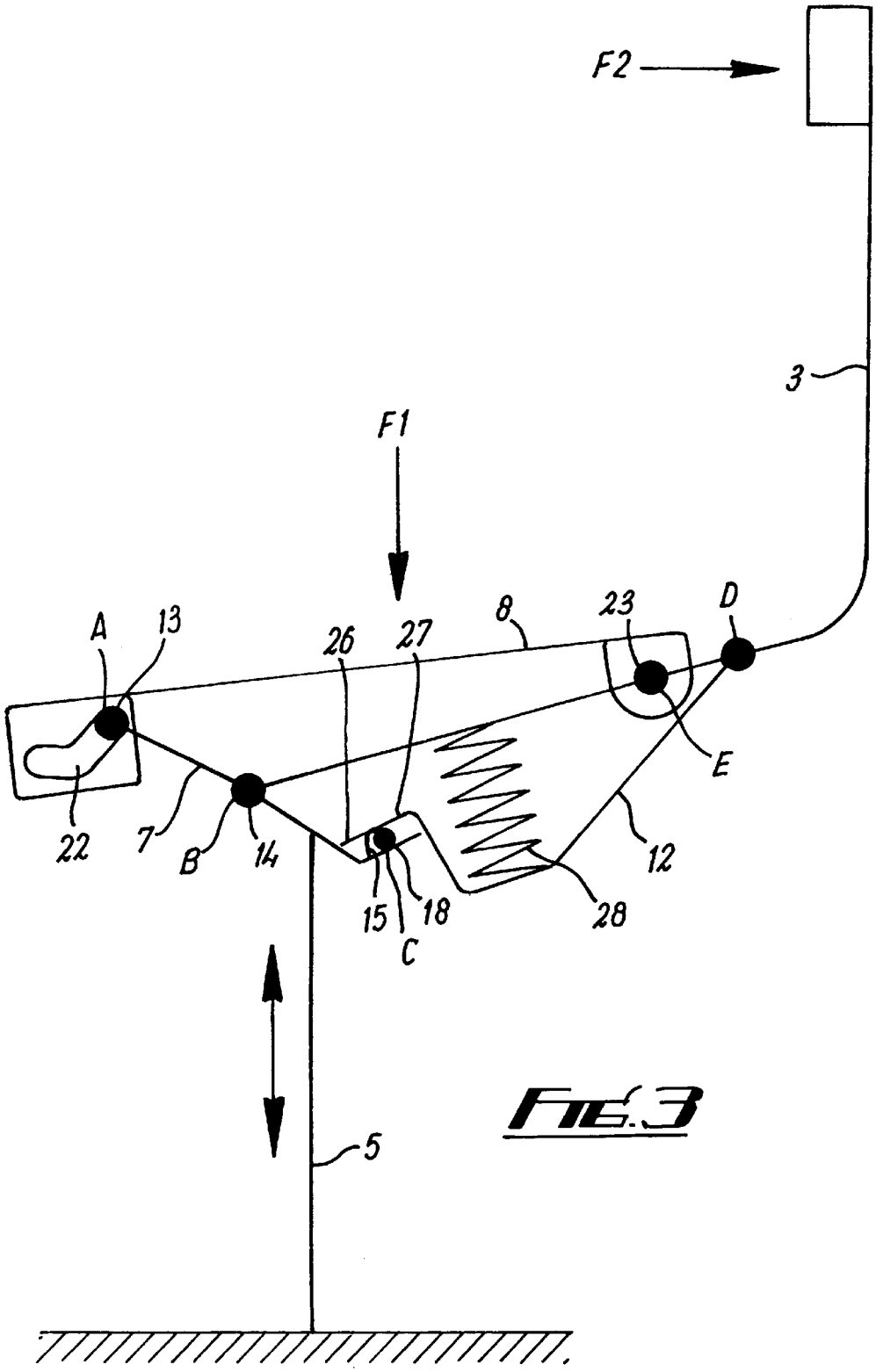
FIGS. 3 & 4 are diagrammatic sketches showing the chair in two extremes of tilt.

As shown in FIG. 3 in the most forwardly tilted position of the seat the forward axle 13 is at the uppermost and rearmost ends of the cam slots 22, and the ramp surfaces 27 engage the projections 15 in the region of the leading ends of the ramp surfaces.

As the seat is titled to the horizontal and then rearwardly the top part 8 pivots about the front axle 13. The upper section 11 of the intermediate part 10 pivots about the main axle 14 and the rear axle 23, and at the same time the U-Bar 31 and the upper section 11 pivot on the pivot bearing 25 on the main axle 14 so as to permit the chair back 3 to pivot rearwardly through a greater angle than the pivoting of the seat 1.

As this pivoting occurs, the ramp surfaces 27 of the projecting arms of the lower section bear on the projections 15 and accordingly the sections 11, 12 pivot D towards each other, about the trailing pivot between the sections 11, 12, and this compresses the spring 28.

At the start of this pivoting movement, i.e. when the seat first moves from the forwardly inclined position to the horizontal, the front axle 13 moves along the cam slots 22 to the forward and lowermost ends of the slots 22. This produces a change in geometry between the front and rear axles 13, 23 which has the effect of indirectly moving the position of the ramp surfaces 27 relative to the different projections 15, 18 by pivotting at B.

In particular, the movable projections 18 are rearwardly displaced relative to the fixed projections 15 whereby initially the ramp surfaces 26 engage the fixed projections 15. After movement of the front axle 13 along the cams 22 the ramp surfaces 27 then engage the movable projections 18. With this arrangement when a person first sits on the chair in its forward tilted position the weight of the person is taken on the fixed projections 15 whereby the movable projections 18 can be readily positionally adjusted by rotation of the shaft 19.

The use of the projections 15, 18 and ramp surfaces 27 gives rise to a swinging movement of the lower section during rearward tilting of the seat. This means that the axis along which the spring force is applied shifts during compression of the spring 28. By appropriate selection of dimensions and geometrical layout of components it is therefore possible to achieve desired spring characteristics throughout the tilting travel of the seat. In particular, it is possible to attain a substantially uniform spring resistance throughout rather than a spring resistance which increases in an uncomfortable or stressful manner as the seat and back are pushed back to the limit of their travel.

The spring tension is pre-set to suit the weight of the person using the chair by adjusting the movable projections 18 with the cam 19*a* on shaft 19. As these projections 18 are moved rearwardly they have a greater deflecting effect on the ramp surfaces 27 whereby the lower section 12 moves upwardly to compress the spring 28 more readily during the tilting movement of the seat.

Figure 4:
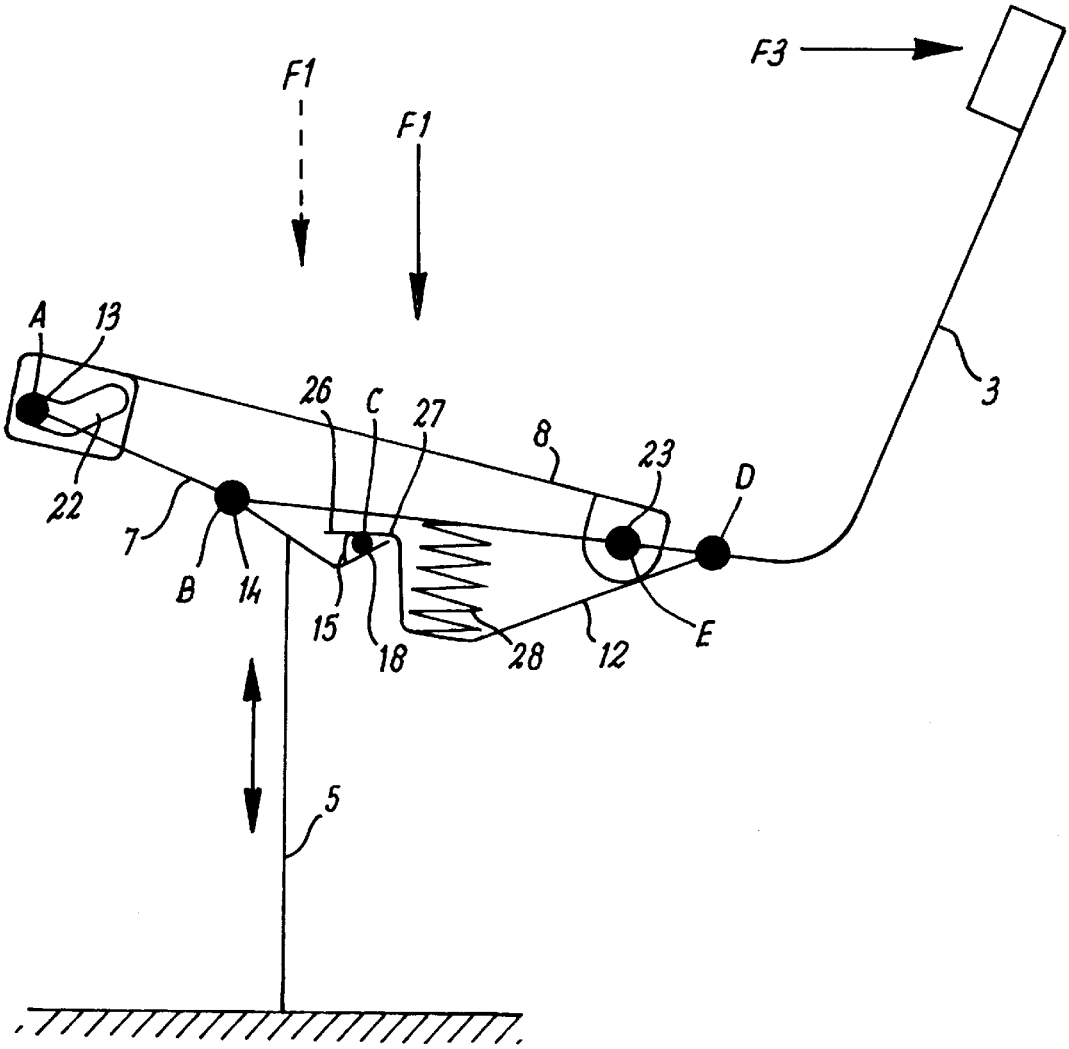
Figure 4A:
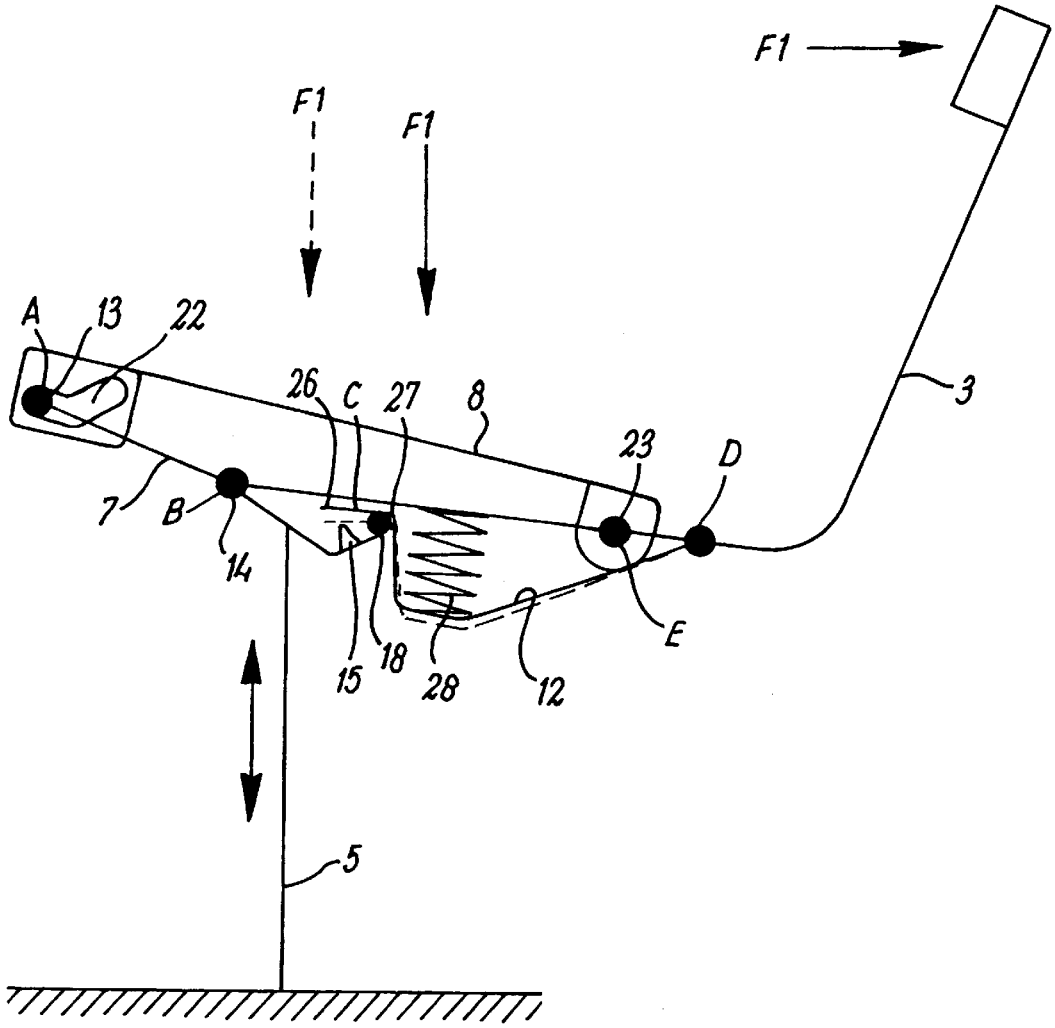
FIG. 4*a* is a view similar to FIG. 4 showing different positions of fulcrum elements.

However, as mentioned, whatever the setting of the movable projections 18, the first part of the tilting movement, corresponding to movement along the cam slots 22, takes place with the ramp surfaces 27 on the fixed projections 15, whereby adjustment of the movable projections 18 can always be effected under zero or low loading conditions. This is illustrated in FIG. 4*a*.

The shape of the projections 15,18 and ramp surfaces 27 is important to facilitate easy movement and thus these parts will be suitably curved, or otherwise shaped, and the projections may comprise rollers or other structures.

With regard to the locking mechanism, this utilises a reversible spring bias on the forked tooth carrier 32. With the shaft 35 rotated in one direction to the locking position the tooth member 33 is strongly spring urged towards the ratchet teeth 34 so that the tooth member 33 engages horizontally a gap between two teeth and thereby prevents relative vertical movement of the ratchet and the tooth member. With the shaft 35 rotated in the opposite direction the tooth member 33 is weakly spring urged away from the ratchet 34 whereby the tooth member 33 remains trapped between the ratchet teeth whilst a person is sitting on the chair with his or her weight applied rearwardly, but the tooth member 33 moves away from the ratchet 34 when the person shifts his or her weight forwardly to allow tilting to take place.

The adjustment shaft 35 can be fixed in the locking position.

With the arrangement so far described, a number of advantages arise with a relatively simple and inexpensive mechanism. In particular, adjustment of spring tension can be effected easily by a person seated on the chair without causing discomfort or risk of strain to the person. Adjustment of tilt angle can also be effected in a particularly easy, comfortable and strain-free manner, particularly having regard to the ease of use of the locking mechanism and due to the described geometry which ensures that the spring resistance does not increase unduly whilst the person on the chair shifts his or her weight and adjusts the tilt angle. The various structural parts of the tilt mechanism can be readily and inexpensively manufactured particularly having regard to the effect of the rearwardly projecting U-shaped member 31 which gives support without requiring a massive costing for the upper section 11.

It is of course to be understood that the invention is not intended to be restricted to the details of the above embodiment which are described by way of example only.

Thus, for example, the pillar 5 need not be vertical or offset but may be disposed in any suitable manner.

The initial free movement to transfer contact from the projections 15 to the projections 18 can be achieved with a linkage other than the cam slot 22 e.g. by a rearward slot or otherwise.

If desired, pivots E and D may be coincident.

As described above, fulcrum projections 15 and 18 are respectively fixed and adjustable. If desired, these may be both fully adjustable.

What is claimed is:

1. An adjustable mechanism for a chair, which chair has a base part, and a seat mounted on the base part so as to be of adjustable inclination relative to the horizontal, said mechanism including a spring arrangement disposed in compression to provide a spring force applied in a direction between the base part and the seat so as to resist said adjustment movement of the seat, wherein the spring arrangement is mounted at opposite ends thereof between pivotally interconnected upper and lower supports, and wherein the lower support has a free end region which is engageable with a fulcrum member about which the lower support pivots during movement of the upper and lower supports towards and away from each other, and an adjustment control operable to effect adjustment of the relative angular disposition of the upper and lower supports and lateral movement of one end of the spring arrangement relative to the other by adjustment of the position of the fulcrum member.

2. A mechanism according to claim 1 wherein the fulcrum member comprises in combination at least one fixed fulcrum element and at least one positionally adjustable fulcrum element arranged such that the said free end region of the lower spring support engages the (or each) fixed element at an initial phase of movement and subsequently engages the (or each) positionally adjustable fulcrum element.

3. A mechanism according to claim 2 wherein the fulcrum member comprises one or more curved projections or rollers, and the end region of the lower spring support comprises one or more curved or angled faces.

4. A mechanism according to claim 1 wherein a linkage is provided to effect movement of the fulcrum member relative to the end region of the lower spring support.

5. A mechanism according to claim 4 Wherein the linkage comprises a cam follower engageable with a cam slot.

6. A mechanism according to claim 5 wherein the cam follower comprises an axle on the base part and the cam slot is provided on the seat.

7. A chair incorporating a mechanism according to claim 1 further including a back part connected to the mechanism so as to move with tilting of the seat.

8. A chair according to claim 7 wherein the back part is connected to the mechanism with a synchro arrangement whereby the back is capable of rearward movement through a greater angle than the seat.

9. A chair according to claim 7 wherein the back part is supported on the upper support, and wherein the upper support comprises a body part with an attached rearwardly projecting rigid elongate support member which provides support for the back part.

10. A chair according to claim 9 wherein the elongate support member comprises a U-shaped steel bar.

11. A chair according to claim 9 wherein a locking mechanism is provided for holding the seat relative to the base part in a selected angular relationship.

12. A chair according to claim 11 wherein the locking mechanism comprises at least one tooth member engageable between teeth of a rack or ratchet member.

13. A chair according to claim 12 further including a spring of reversible effect whereby in one mode it acts to urge the (or each) tooth member into locking engagement with the rack or ratchet, and in a further mode it acts to urge the (or each) tooth member out of engagement with the rack or ratchet.

14. A chair according to claim 11 wherein said locking mechanism comprises at least one tooth member engageable between teeth of at least one rack or ratchet member, a spring arrangement operable in two modes respectively to urge the (or each) tooth member into engagement with the (or each) rack or ratchet and to urge the (or each) tooth member out of such engagement on release of retaining force acting on the (or each) said tooth member transversely thereto along the (or each) rack or ratchet, and a control for switching between said modes.

15. An adjustable mechanism for a chair, which chair has a base part, and a seat mounted on the base part so as to be of adjustable inclination relative to the horizontal, said mechanism including a spring arrangement disposed in compression to provide a spring force applied in a direction between the base part and the seat so as to resist said adjustment movement of the seat, wherein the spring arrangement is mounted at opposite ends thereof between pivotally interconnected upper and lower supports, and wherein the lower support contacts one or more fixed fulcrum elements when the seat is in an initial or forward tilted position and then engages one or more positionally adjustable fulcrum elements during rearward tilting of the seat, such that the axis along which the spring force is applied shifts during compression, and a spring tension adjustment control which comprises a movable projection in each of the one or more adjustable fulcrum elements whereby a user can achieve substantially uniform spring resistance throughout the tilting movement of the chair.

16. A chair as claimed in claim 15 further including a back part connected to the mechanism so as to move with tilting of the seat.

17. A chair as claimed in claim 16 wherein the back part is connected to the mechanism with a synchro arrangement whereby the back is capable of rearward movement through a greater angle than the seat.

18. A chair according to claim 17 wherein a locking mechanism is provided for holding the seat relative to the base part in a selected angular relationship.

19. A mechanism as claimed in claim 15 wherein a linkage is provided to effect movement of the fulcrum member relative to the end region of the lower spring support.

20. A mechanism according to claim 19 wherein the linkage comprises a cam follower engageable with a cam slot.

* * * * *